US008033316B2

(12) United States Patent
Hirata

(10) Patent No.: US 8,033,316 B2
(45) Date of Patent: Oct. 11, 2011

(54) FLASK UNIT AND COPE-AND-DRAG MOLDING MACHINE AND LINE

(75) Inventor: Minoru Hirata, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 513 days.

(21) Appl. No.: 11/921,736

(22) PCT Filed: Jun. 2, 2006

(86) PCT No.: PCT/JP2006/311070

§ 371 (c)(1),
(2), (4) Date: Dec. 7, 2007

(87) PCT Pub. No.: WO2006/132140

PCT Pub. Date: Dec. 14, 2006

(65) Prior Publication Data

US 2009/0095437 A1 Apr. 16, 2009

(30) Foreign Application Priority Data

Jun. 7, 2005 (JP) ..... 2005-166305

(51) Int. Cl.
*B22C 11/00* (2006.01)

(52) U.S. Cl. ..... 164/374; 164/184

(58) Field of Classification Search ..... 164/374, 164/184

See application file for complete search history.

(56) References Cited

U.S. PATENT DOCUMENTS

| | | | | |
|---|---|---|---|---|
| 3,229,336 | A * | 1/1966 | Hunter et al. | 164/195 |
| 4,348,641 | A | 9/1982 | Scott et al. | |
| 4,832,108 | A * | 5/1989 | Nagarwalla et al. | 164/180 |
| 5,246,058 | A * | 9/1993 | Murata | 164/182 |

FOREIGN PATENT DOCUMENTS

| | | |
|---|---|---|
| JP | 49-41451 | 11/1974 |
| JP | 57-195557 A | 12/1982 |
| JP | 7-16705 | 1/1995 |
| JP | 2003-103345 A | 4/2003 |
| JP | 2003-326358 A | 11/2003 |

OTHER PUBLICATIONS

Machine Translation of JP 2003-103345, which originally published Apr. 8, 2003.*
International Search Report dated Sep. 5, 2006.

* cited by examiner

*Primary Examiner* — Jessica L Ward
*Assistant Examiner* — Nicholas D'Aniello
(74) *Attorney, Agent, or Firm* — Finnegan, Henderson, Farabow, Garrett, & Dunner, L.L.P.

(57) ABSTRACT

A flask unit for producing a cope and a drag that are stacked, comprising at least two uprightly disposed connecting rods (4), a cope flask slidably fitted on the connecting rods and formed with a molding sand blowing-in port in one of its sides, and a drag flask slidably fitted on the connecting rods so that it is located under the cope flask to mate it, the drag flask being formed with a molding sand blowing-in port in one of the sides thereof.

1 Claim, 8 Drawing Sheets

FLASK UNIT AND COPE-AND-DRAG MOLDING MACHINE AND LINE

FIELD OF THE INVENTION

This invention relates to a flask unit and a cope-and-drag molding machine and line for molding a flaskless or flask-tight cope and drag using the flask unit.

BACKGROUND ART

JP A 7-16705 discloses one conventional molding machine. This machine is a horizontally split type molding machine that includes a molding sand blowing tank with downwardly-facing nozzles, and an L-shaped frame carrying a cope on the vertical surface of the vertical side of the L-shaped frame so that the cope is vertically moved and also carrying a drag on the horizontal surface of the horizontal side of the L-shaped frame so that the drag is reciprocatingly moved between a position opposing the cope and another position that is outside the opposing position, wherein the L-shaped frame is rotatable between a position outside the molding sand blowing tank and another position under the tank.

In this conventional molding machine arranged as explained above, the cope and the drag tend to be partially stacked on each other, or shifted, or a slit is produced between them when they are stacked, since they are supported by the sides of the L-shaped frame in a cantilever manner. This inherently causes a problem in that a defective cast that has a fin or the like is produced.

The present invention has been conceived in view of that problem. It aims to provide a flask unit of a cope and a drag that can be aligned, but not partially mated, and that have a molding sand blowing-in port at their side. The present invention also aims to provide a molding machine and line for molding a flaskless or tight-flask cope and drag using the flask unit of the invention.

SUMMARY OF THE INVENTION

The flask unit of the present invention is one for producing a cope and a drag that are stacked on each other, comprising at least two uprightly disposed connecting rods; a cope flask slidably fitted on the connecting rods and formed with a molding sand blowing-in port in one of the sides thereof, and a drag flask slidably fitted on the connecting rods at their lower parts to be located under the cope flask to mate it and formed with a molding sand blowing-in port in one of the sides thereof.

The cope and drag of the flask unit slide on the connecting rods, or they are supported at both their ends so that they directly face and mate each other. This arrangement prevents them from being misaligned. Further, since they have the sand blowing-in ports, they can be used for the molding machine of the type that rotates the flasks.

In one aspect, the molding machine of the present invention is one for molding a cope and a drag that are stacked by using the flask unit of the present invention, comprising a match plate to be placed in and out of a position between the cope flask and the drag flask of the flask unit mounted on the molding machine; a molding sand squeeze mechanism to which the flask unit is detachably attached, allowing the match plate to be sandwiched between the cope flask and the drag flask and allowing an upper squeeze means and a lower squeeze means to advance in those respective openings of the cope flask and the drag flask that are not closed by the match plate and to retract therefrom, the molding sand squeeze mechanism being rotatable clockwise and counterclockwise between a position where the cope flask and the drag flask sandwiching the match plate are kept horizontal and a position where the cope flask and the drag flask sandwiching the match plate are kept vertical; a rotating mechanism for rotating the molding sand squeeze mechanism clockwise and counterclockwise; and a sand blowing mechanism for blowing molding sand into the vertically kept cope and drag flasks through the sand blowing-in ports thereof.

The molding line of the present invention is one for circulating a flask unit for reuse, comprising the molding machine for molding a cope and a drag that are stacked of the present invention, the flask unit being detachably attached to the molding machine; a pouring line for pouring molten metal in the cope and the drag of the flask unit forwarded from the molding machine; a mold removing device for withdrawing the cope and the drag from the flask unit poured with the molten metal at the pouring line; and a flask unit forwarding device for forwarding the flask unit from which the cope and the drag has been withdrawn to the molding machine for the reuse.

In another aspect, the molding machine of the present invention is one for molding a flaskless cope and a flaskless drag that are stacked, by using the flask unit of the present invention, comprising a machine body, the flask unit being detachably attached to the machine body; a match plate to be placed in and out of a position between the cope flask and the drag flask of the flask unit attached to the molding machine, a molding sand squeeze mechanism for allowing the match plate to be sandwiched between the cope flask and the drag flask and allowing an upper squeeze means and a lower squeeze means to advance in those respective openings of the cope flask and the drag flask that are not closed by the match plate and to retract therefrom, the molding sand squeeze mechanism being rotatable clockwise and counterclockwise between a position where the cope flask and the drag flask sandwiching the match plate are horizontal and a position where the cope flask and the drag flask sandwiching the match plate are vertical; a rotating mechanism for rotating the molding sand squeeze mechanism clockwise and counterclockwise; a sand blowing mechanism for blowing molding sand into the vertically kept cope and drag flasks through the sand blowing-in ports thereof; a mold withdrawing mechanism for withdrawing the cope and the drag from a pair of the cope flask and the drag flask holding the cope and the drag that are stacked and are in the horizontal position; and a flask rotating mechanism for intermittently rotating two or more pairs of the copes and the drags stacked in each pair with the pairs being horizontally distributed between the molding sand squeeze mechanism and the mold withdrawing mechanism, and for elevating the cope flask.

BEST MODE FOR CARRYING OUT THE INVENTION

Figure 1:
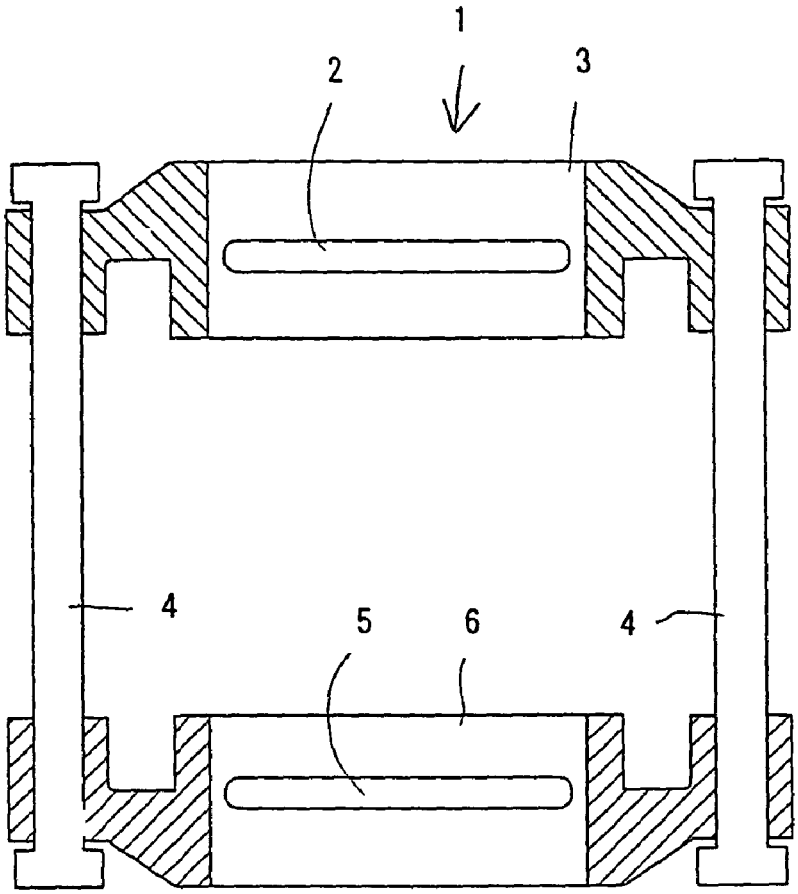
FIG. 1 is a cross-sectional view of the best mode of a flask unit of the present invention.
Figure 2:
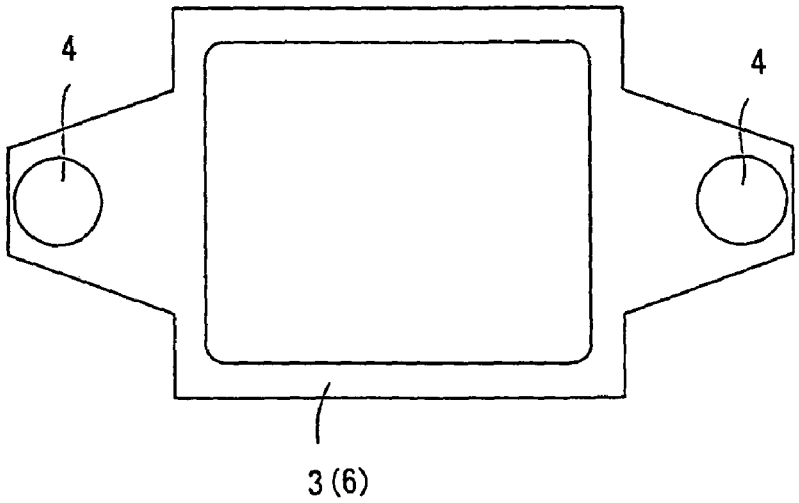
FIG. 2 is a plan view of the flask unit of FIG. 1.

In FIGS. 1 and 2, the best mode of the flask unit 1 of the present invention comprises a cope flask 3, two connecting rods 4, 4 on which the cope flask is slidably mounted or fitted, and a drag flask 6 slidably mounted, or fitted, on the two connecting rods 4, 4 so that it is located under the cope flask 3. The cope flask 3 is formed with a molding sand blowing-in port 2 in one of its sides, and the drag flask is also formed with a molding sand blowing-in port 5 in one of its sides.

Figure 3:
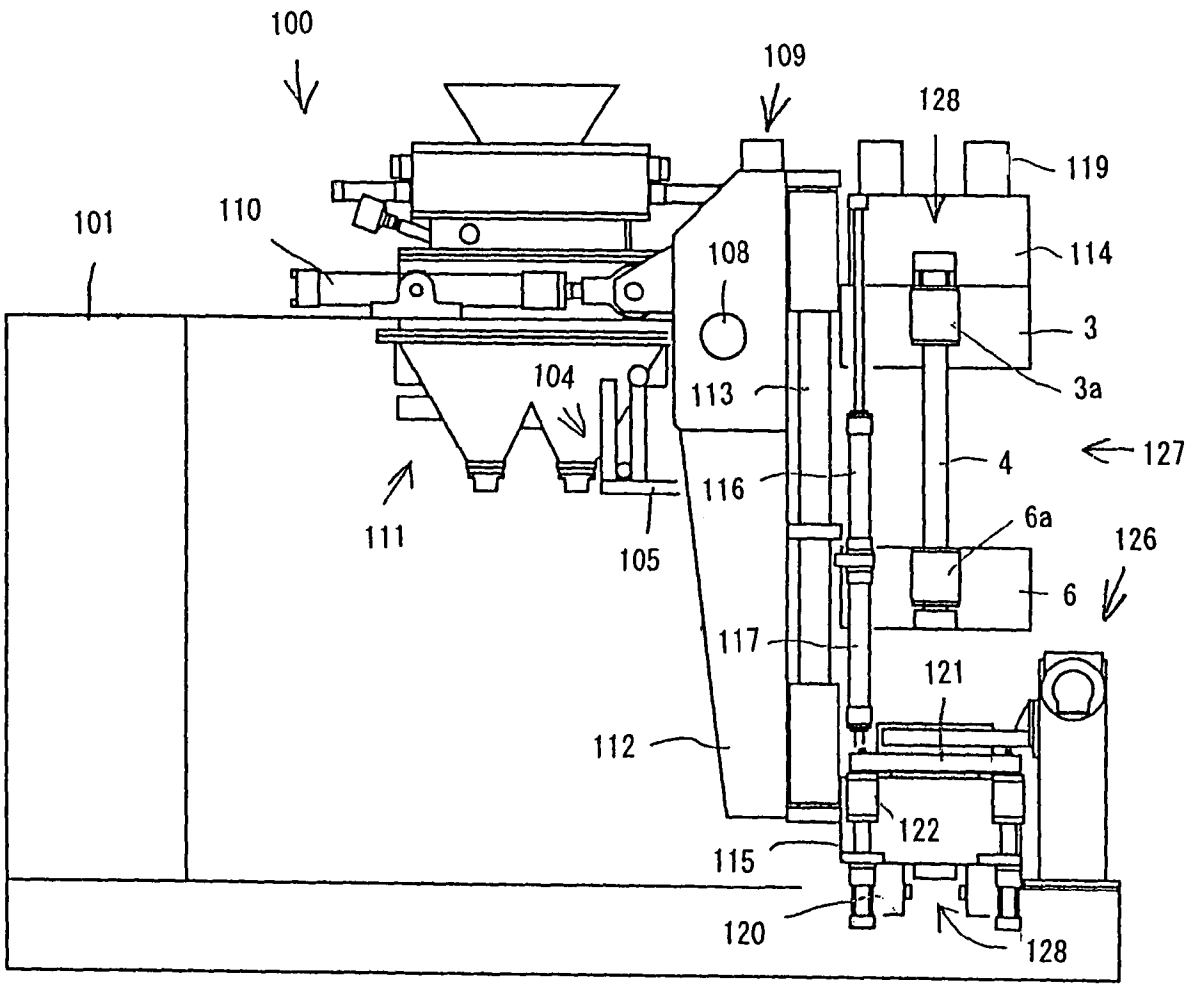
FIG. 3 is a plan view of one embodiment of the cope-and-drag molding machine of the present invention that uses the best mode of the flask unit.
Figure 4:
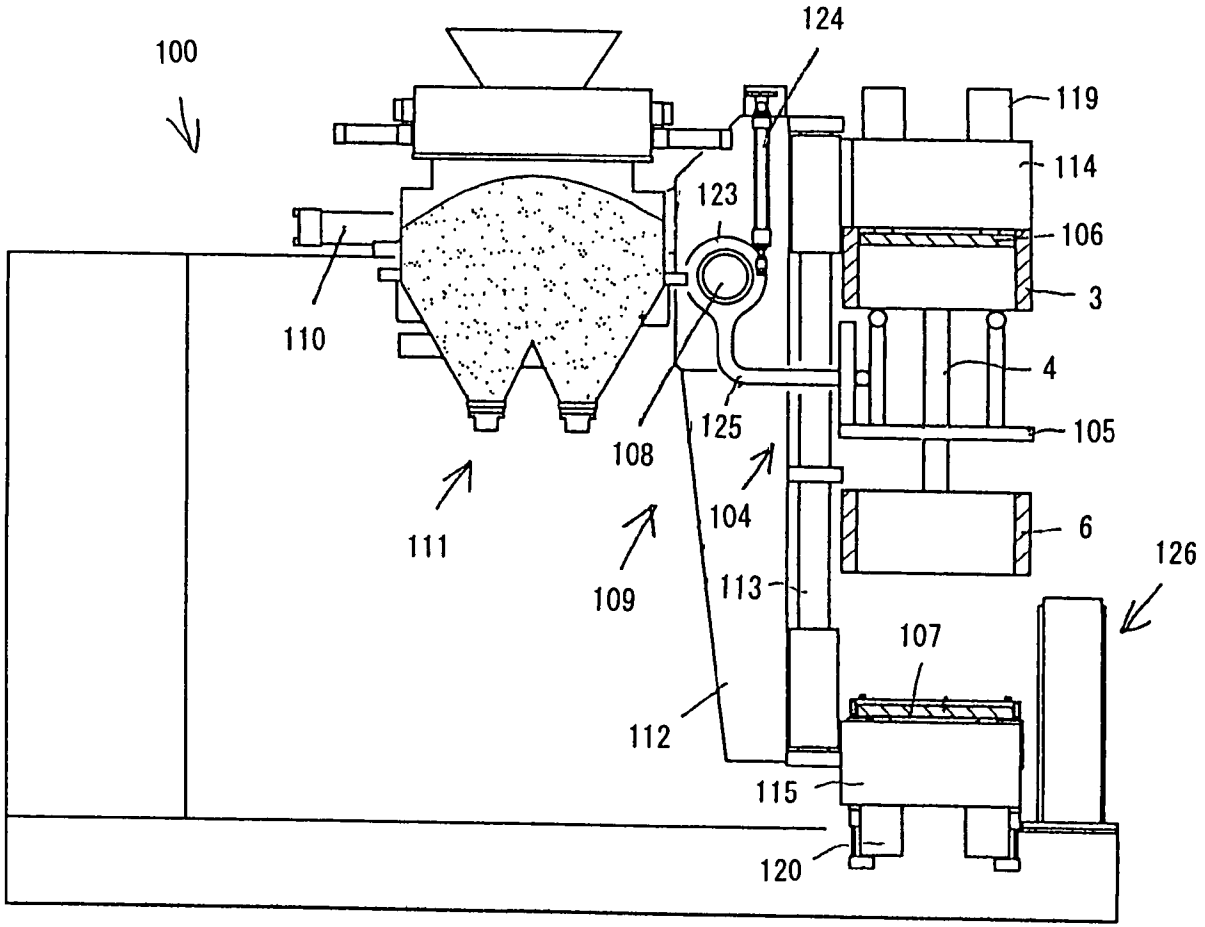
FIG. 4 is a fragmentary cross-sectional view of the cope-and-drag molding machine of FIG. 3.
Figure 5:
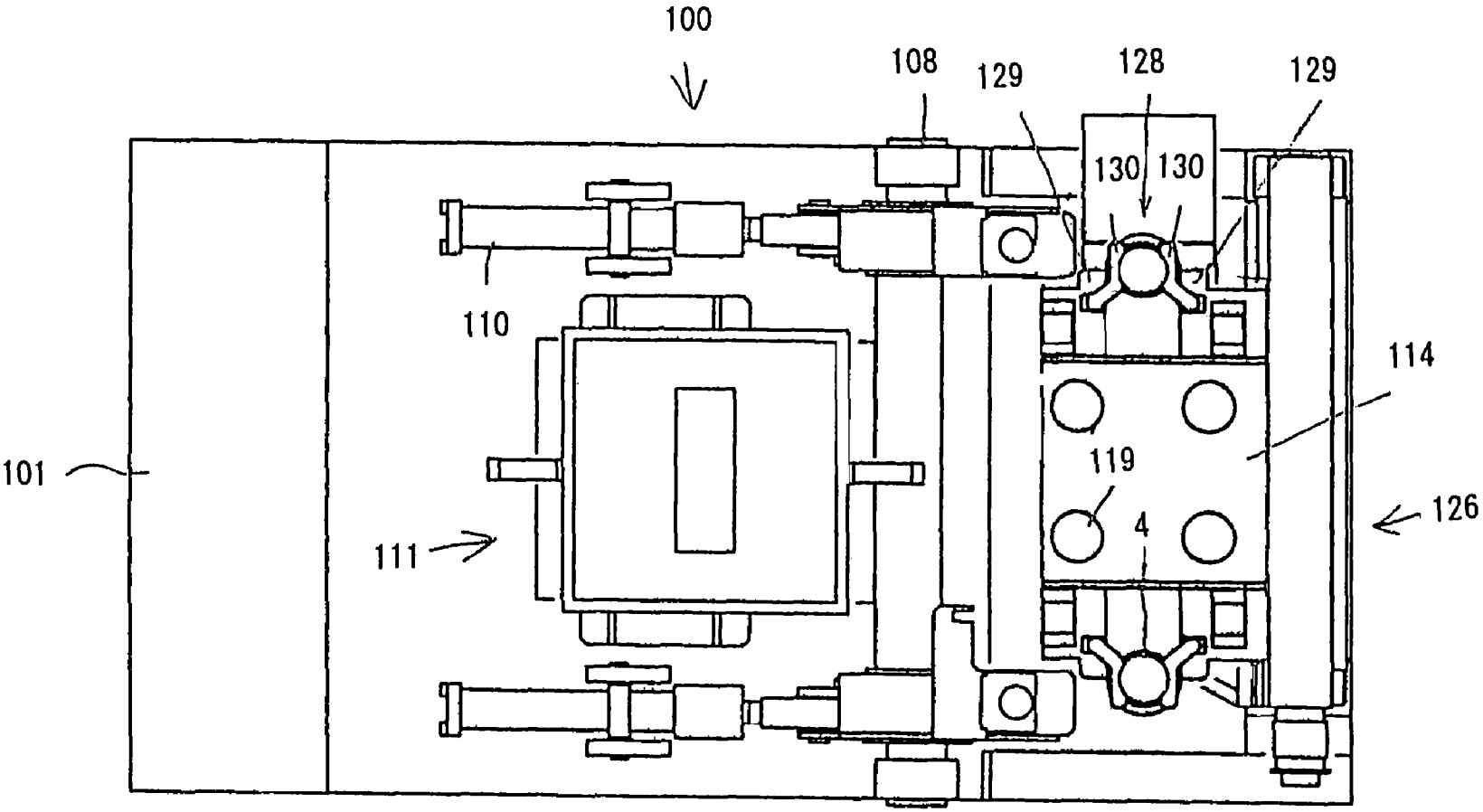
FIG. 5 is a plan view of the cope-and-drag molding machine of FIG. 3.

One embodiment of the cope-and-flask molding machine 100 of the present invention, which uses the flask unit 1 detachably mounted on it, is now explained based on FIGS. 3-5. The cope-and-flask molding machine 100 comprises a machine base 101 defining a space therein; a match plate 105 mounted to be placed in and out of a position between the cope flask 3 and the drag flask 6 of the flask unit 1 by a transfer mechanism 104; a molding sand squeeze mechanism 109 to which the flask unit 1 is detachably attached by means of a pair of clamping mechanisms 128, 128, allowing the match plate 105 to be sandwiched between the cope flask 3 and the drag flask 6 and allowing an upper squeeze plate, or squeeze means, 106 and a lower squeeze plate, or squeeze means, 107 to advance in those respective openings of the cope flask and the drag flask that are not closed by the match plate and allowing them to retract therefrom, the molding sand squeeze mechanism 109 being rotatable clockwise and counterclockwise about a bearing shaft 108 between a position where the cope flask and the drag flask sandwiching the match plate are horizontal and a position where the cope flask and the drag flask sandwiching the match plate are made vertical; two laterally-facing cylinders 110, 110 as a rotating mechanism for rotating the molding sand squeeze mechanism 109 clockwise and counterclockwise; and a sand blowing mechanism 111 for blowing molding sand into the cope and drag flasks, which are made vertical by the cylinders 110, 110, through the sand blowing-in ports 2, 5.

Further, the lower and upper parts of the connecting rods 4, 4 are formed with grooves engaged by nails or lever arms 130 of the clamping mechanisms 128, 128, as explained below in detail. As in FIG. 5, the clamping mechanisms 128, 128 are mounted on an upper elevating frame 114 at its front and rear, outer surfaces and are provided with a pair of oscillating motors 129, 129 and a pair of nails or lever arms 130, 130 fit on the oscillating output shaft of each oscillating motor 129 so that the pairs of nails advance into the grooves formed in the upper parts of the connecting rods 4, 4 to hold the upper parts therebetween when the oscillating motors 129, 129 operate. The same clamping mechanisms 128 are also mounted on a lower elevating frame 115 (below explained) at its front and rear, outer surfaces so that their nails advance into the grooves formed in the lower parts of the connecting rods 4, 4 to hold the lower parts therebetween.

In the molding sand squeeze mechanism 109, as in FIGS. 3 and 4, a rotary frame 112 is pivotably mounted on the bearing shaft 108 so that it is rotated clockwise and counterclockwise in a vertical plane. A pair of vertically extending guide rods 113, 113, which are spaced apart in the frontward and rearward directions, are mounted on the right side of the rotary frame 112. Further, the upper elevating frame 114, which is shaped like an up side down L, is slidably mounted on the guide rods 113, 113 at their upper parts though holders integrally formed with the upper elevating frame so that it is held between the upper parts, while the lower elevating frame 115, which is shaped like an L, is slidably mounted on the guide rods 113, 113 at their lower parts through holders integrally formed with the lower elevating frame so that it is held between the lower parts. The upper and lower elevating frames 114, 115 are moved toward and away from each other by the extension and retraction of an upwardly-facing cylinder 116 and a downwardly-facing cylinder 117, which are mounted on the rotary frame 112.

Further, a plurality of cylinders 119, 119 for advancing and retracting the upper squeeze plate 106 are mounted on the upper elevating frame 114, while a plurality of cylinders 120, 120 for advancing and retracting the lower squeeze plate 107 are mounted on the lower elevating frame 115. The horizontal upper surfaces of the upper and lower elevating frame are sized so that they can push the cope flask 3 and drag flask 6. Further, upwardly-facing cylinders 122, 122 are mounted on the front and rear, outer surfaces of the lower elevating frame 115, and a frame-like leveling frame 121 is mounted on the upper ends of the piston rods of the upwardly-facing cylinders 122, 122 so that the leveling frame 121 is slidably fit on the lower squeeze plate 107.

Further, as in FIGS. 3 and 4, the transfer mechanism 104 for the match plate 105 comprises a ring member 123 pivotably mounted on the bearing shaft 108 of the molding sand squeeze mechanism 109, a cylinder 124 pivotably mounted on the rotary frame 112 of the sand blowing mechanism 111 with the distal end of its piston rod being pivotably connected to a part of the ring member 123, so that the distal end moves together with the ring member, a pair of cantilevered arms 125, 125 with their proximal ends being secured to the ring member 123, and a suspended cart (not shown) carrying the match plate 105 thereon for reciprocatingly moving to the right and left. Accordingly, by extending and retracting the cylinder 124 the pair of the arms 125, 125 are vertically rotated to allow the cart to transfer the match plate 105 to and away from the position between the horizontal cope and drag of the mold squeeze mechanism 109. The pair of arms 125, 125 may be moved by a motor etc. instead of the cylinder 124.

The sand blowing mechanism 111 is disposed at the left top of the machine base 101 and is provided with two aeration tanks (not shown). The aeration tanks independently work to blow the molding sand into the cope and drag, although typically only one aeration tank is used to blow the molding sand into the cope and drag flasks. The pressure of the compressed air for the aeration is preferably 0.05-0.18 MPa.

Figure 6:
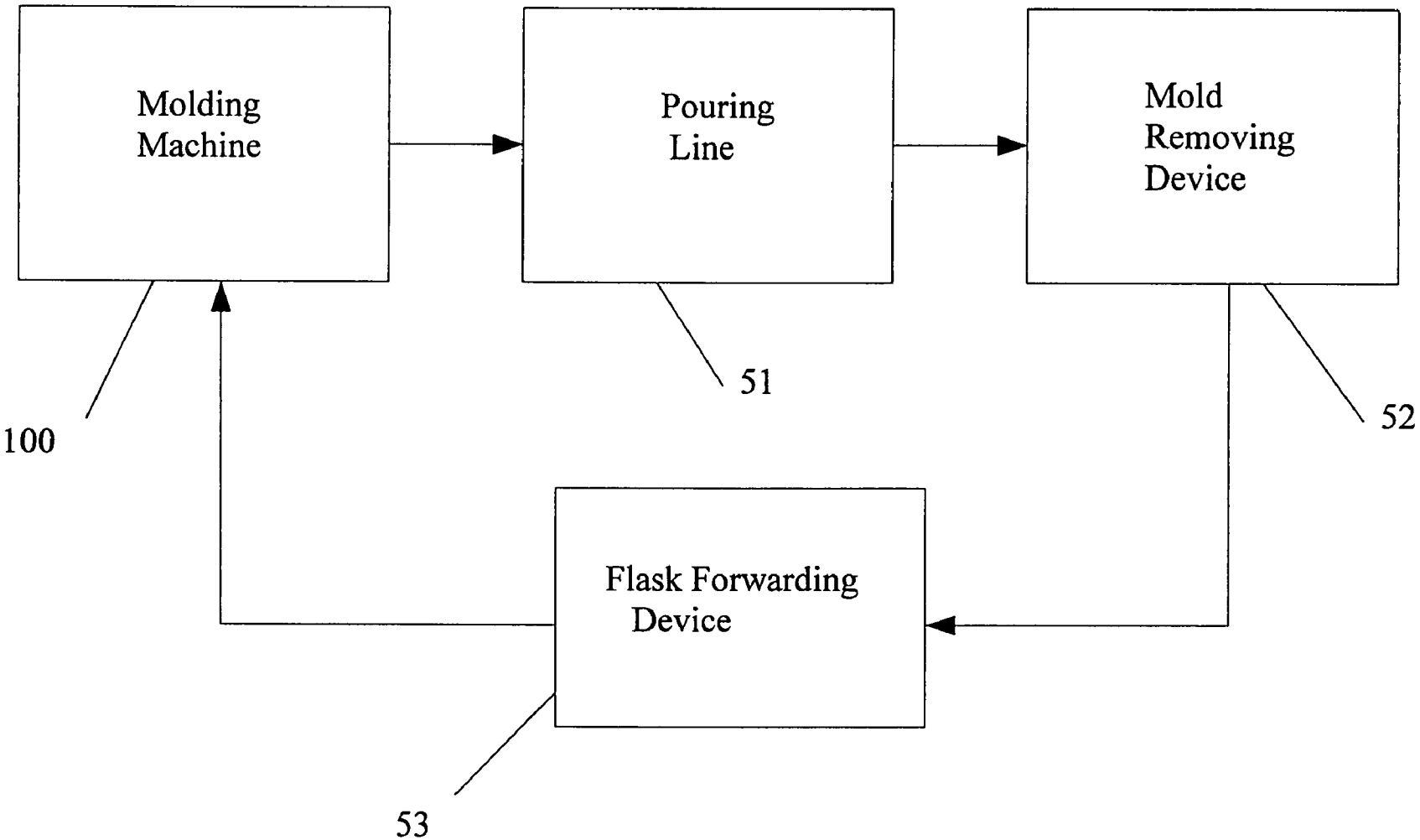
FIG. 6 is a block diagram of a molding line that uses the best mode of the flask unit.

Further, as in FIG. 6, the flask unit 1, which holds the cope and drag produced by using the cope-and-drag molding machine 100 explained above, is circulated in the molding line, that is, it is moved from the molding machine 100 through a pouring line 51 where the cope and drag are poured with molten metal and a mold removing device 52 where the cope and drag are withdrawn from the flask unit, and it is then forwarded or returned to the molding machine 100 by a flask unit forwarding device 53 for reuse.

In the operation of the molding machine, first the transfer mechanism 105 is moved to the position between the horizontal cope and drag of the flask unit by the transfer mechanism 104. The cope flask 3 is then moved up and down a short distance by extending and retracting the cylinder 116, while the arms 125 are rotated clockwise by retracting the cylinder 124 of the transfer mechanism 10 to disengage the arms from the cart and the arms are returned. The upwardly-facing cylinder 116 and the downwardly-facing cylinder 117 of the molding sand squeeze mechanism 109 are then retracted to allow the cope flask 3 and the drag flask 6 to approach each other by means of the upper and lower elevating frames 114, 115 to sandwich the match plate therebetween. The pair of lower clamping mechanisms 128, 128 then hold the lower parts of the connecting rods 4, 4 therebetween. The cylinders 119, 119, 120, 120 are then extended by a desired distance to advance the upper and lower squeeze plates 106, 107 in the cope flask 3 and the drag flask 6 by the desired distance, respectively, to form two molding spaces.

The cylinder 110 is then extended to rotate the sand squeeze mechanism 109 clockwise about the bearing shaft 108 to place the cope and drag flasks 3, 6 in the vertical position and to move the sand blowing-in ports up to connect the ports to the lower part of the aeration tank. The sand blowing mechanism then blows the molding sand into the upper and lower molding spaces through the sand blowing-in ports. The cylinders 119, 119, 120, 120 are then extended to further advance the upper and lower squeeze plates to squeeze the molding sand in the upper and lower molding spaces.

The reaction that acts on the cylinders 119, 119, 120, 120 when the molding sand in the molding spaces is squeezed is also received by the upper and lower clamping mechanisms 128, 128 and the connecting rods 4, 4.

The cylinder 110 is then retracted to return the cope and drag flasks 3, 6 and the match plate 105 to the horizontal position, while the lower clamping mechanisms 128, 128 are disengaged from the connecting rods 4, 4. The upwardly-facing and downwardly-facing cylinders 106, 107 are then extended to move the cope flask 3 up and to move the drag flask 6 down by means of the upper and lower elevating frames 114, 115 to separate the cope and drag flasks 3, 6, which hold the sand molds produced by squeezing the molding sand, from the match plate 105. The drag flask 6 is suspended by the connecting rods 4, 4. The cylinder 124 is then retracted to transfer the match plate 105 away from the position between the cope flask 3 and the drag flask 6 by the arms 125, 125. A core is then set in the mold, if necessary, and the upwardly-facing and downwardly-facing cylinders 106, 107 are then retracted to move the cope flask 3 down and to move the drag flask 6 up by means of the upper and lower elevating frames 114, 115 to superimpose the cope tight flask 3 on the drag tight flask 6.

The clamping mechanisms 128, 128 are then disengaged from the connecting rods 4, 4, and the flask unit 1, including the cope tight flask 3 and the drag tight flask 6, is taken out from the cope-and-drag molding machine 100. The cope and the drag in the flask unit 1 are then poured with molten metal at the pouring line 54. The cope and the drag are then withdrawn from the flask unit by the mold removing device 52, and the flask unit from which the molds are taken out is then forwarded from the mold removing device 52 to the cope-and-drag molding machine 100 by the flask unit forwarding device 53.

Figure 8:
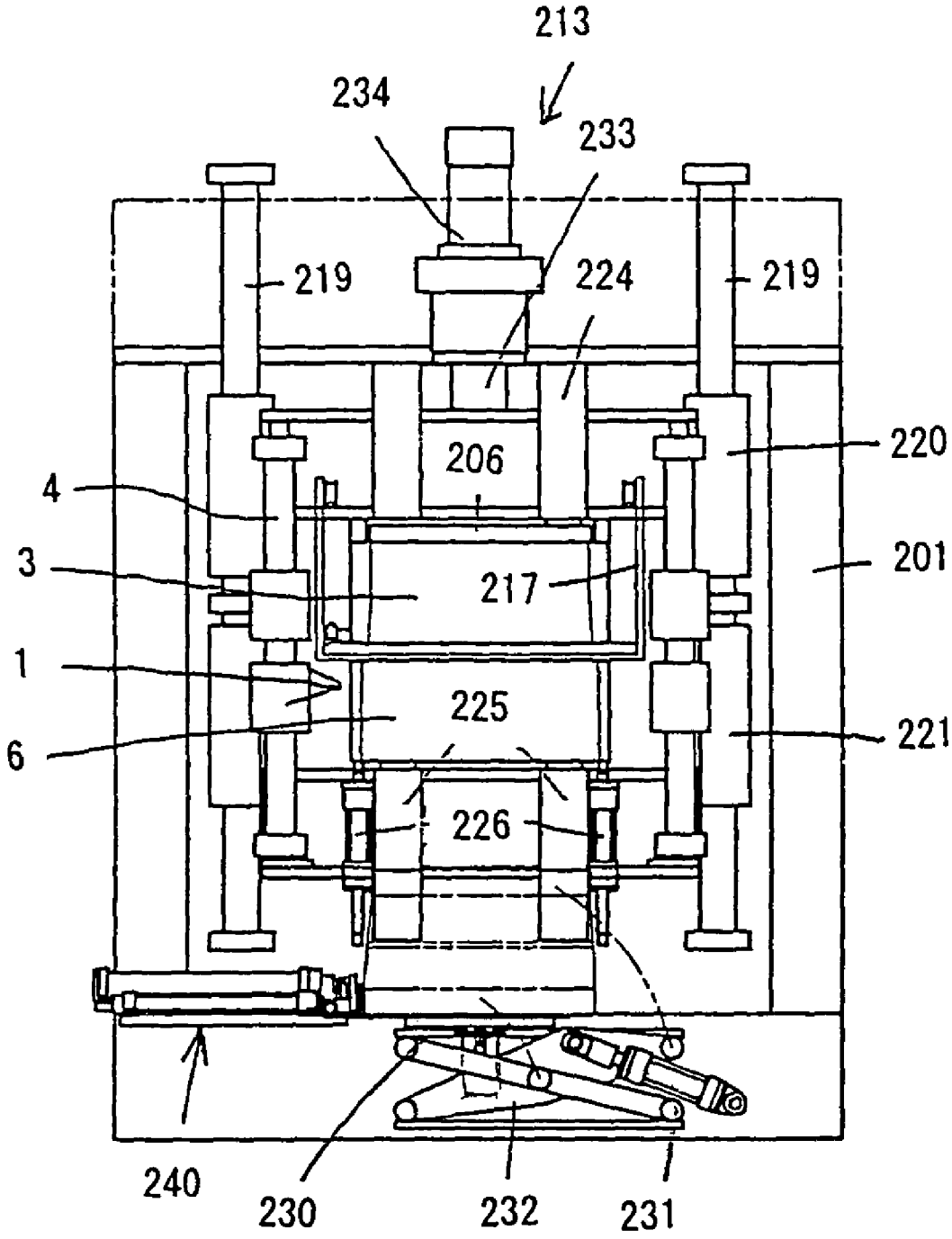
FIG. 8 is a side view taken along arrows A, A of FIG. 7, showing a match plate sandwiched by a cope flask and a drag flask.
Figure 9:
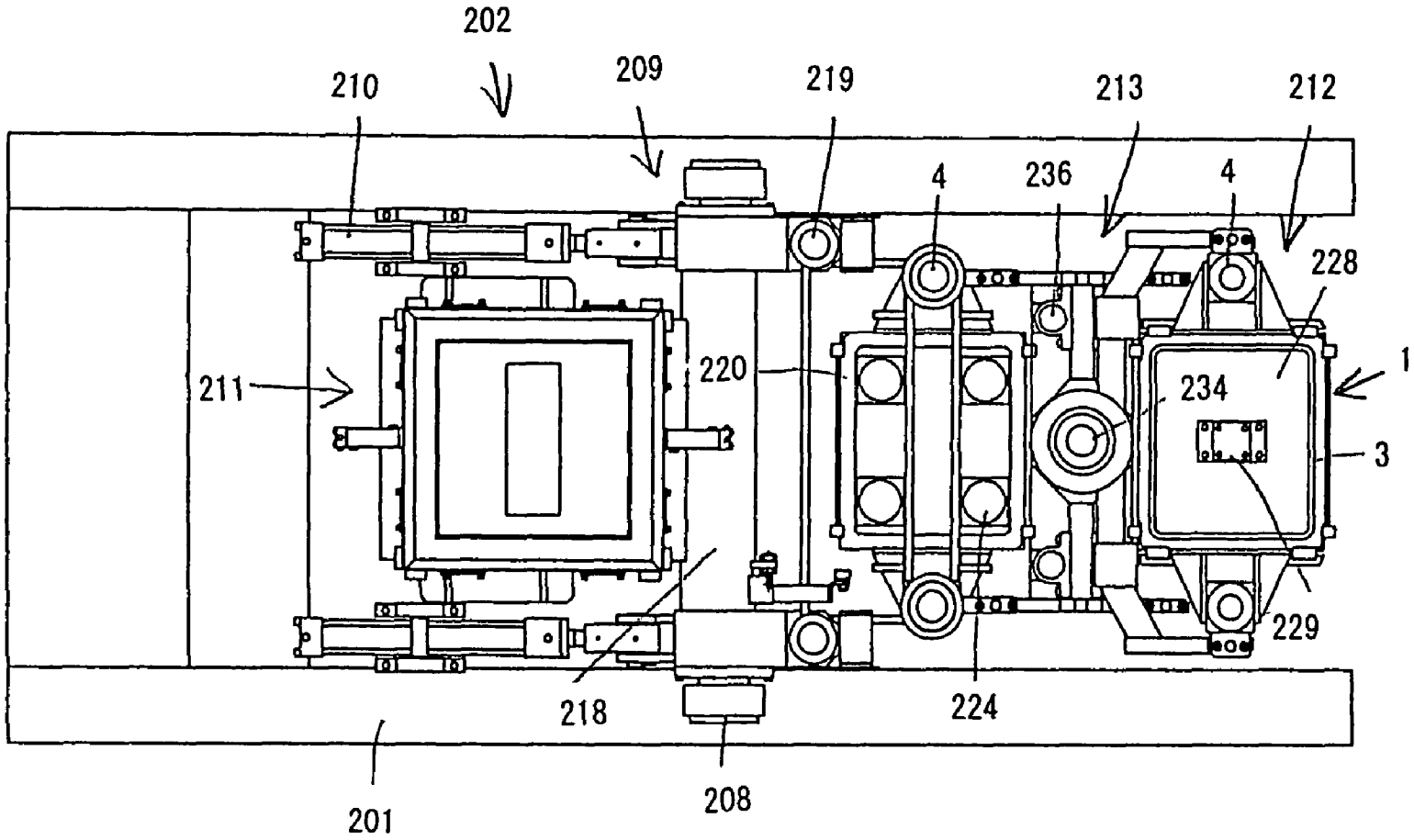
FIG. 9 is a plan view of the cope-and-drag molding machine of FIG. 7.

Although the flask unit 1 used in the drag-and-cope molding machine 100 of the above embodiment is to produce tight-flask molds, it is also used in a molding machine for producing a flaskless cope and a flaskless drag as shown in the next embodiment. Namely, as in FIGS. 7-9, the molding machine for molding a flaskless cope and a flaskless drag comprises a parallelepiped machine base 201 forming a space therein; a machine body 202 detachably mounted by the flask unit 1; a match plate 205 to be placed in and out of a position between the cope flask 3 and the drag flask 6 of the flask unit 1; a molding sand squeeze mechanism 209 for allowing the match plate 205 to be sandwiched between the cope flask 3 and the drag flask 6 and allowing an upper squeeze plate 206 as upper squeeze means and a lower squeeze plate 207 as lower squeeze means to advance in those respective openings of the cope flask 3 and the drag flask 6 that are not closed by the match plate 205 and allowing them to retract therefrom, the molding sand squeeze mechanism being rotatable clockwise and counterclockwise between a position where the cope flask 3 and the drag flask 6 sandwiching the match plate 205 are horizontal and a position where the cope flask and the drag flask sandwiching the match plate are vertical; a laterally-facing cylinder 210 as a rotating mechanism for rotating the molding sand squeeze mechanism 209 clockwise and counterclockwise; a sand blowing mechanism 211 for blowing molding sand into the cope and drag flasks located in the vertical position by extending the laterally-facing cylinder 210, through the sand blowing-in ports of the flasks; a mold withdrawing mechanism 212 for withdrawing the cope and the drag from a pair of the cope flask 3 and the drag flask 6 holding the cope and drag that are stacked and are in the horizontal position; and a flask rotating mechanism 213 for alternately and intermittently rotating more than two horizontally distributed pairs of the copes and the drags that are stacked in each pair, between the molding sand squeeze mechanism 209 and the mold withdrawing mechanism 212, the flask rotating mechanism 213 being elevatable while being engaging with the cope flask 3.

Figure 7:
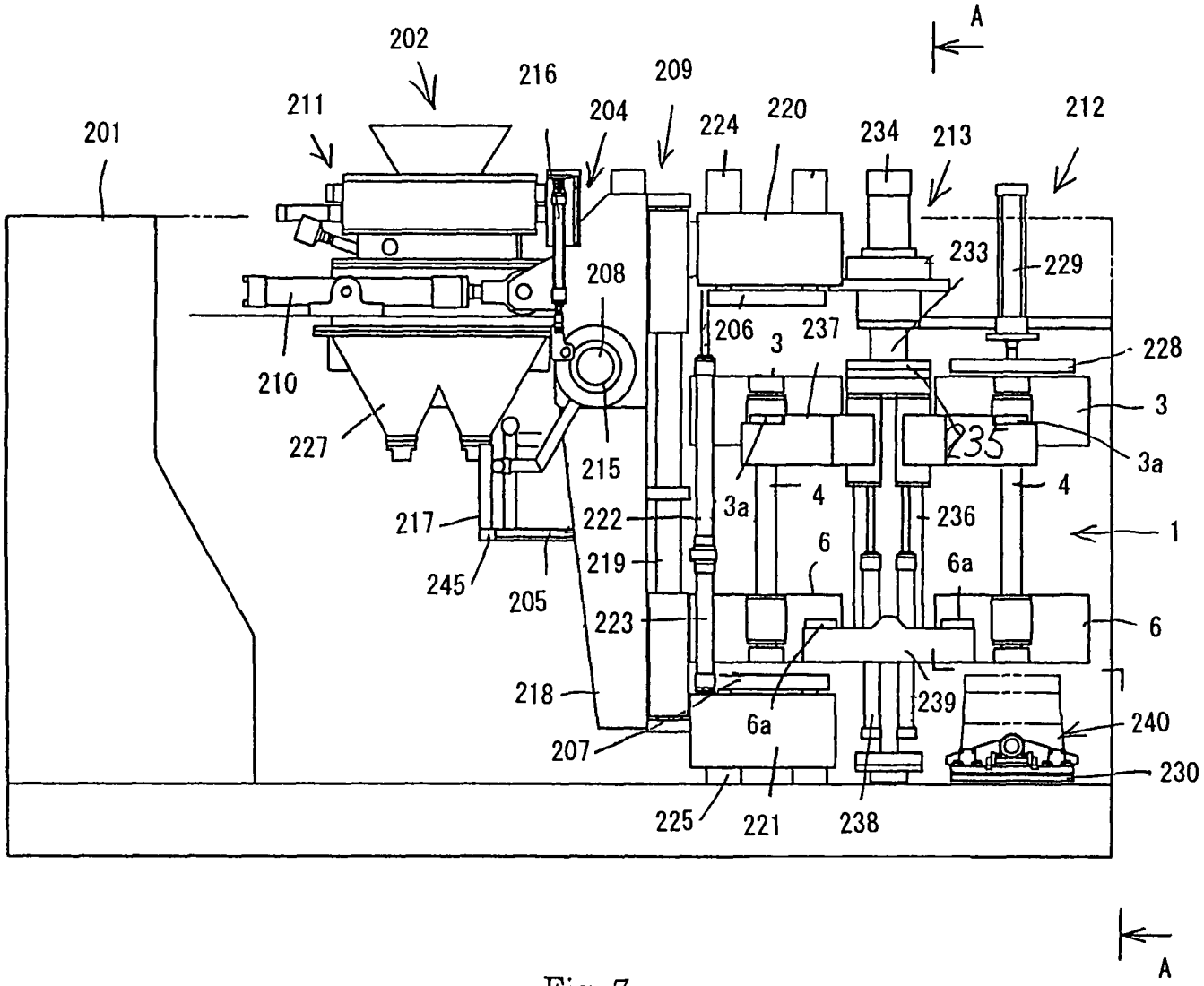
FIG. 7 is a plan view of another embodiment of the cope-and-drag molding machine of the present invention that uses the best mode of the flask unit.

Further, as in FIG. 7, each cope flask 3 of the two pairs of cope flasks 3 and drag flasks 6 is formed with a projection 3*a* at the central part of the front and rear, outer surfaces thereof, and each drag flask 6 is formed with a projection 6*a* at the rightward position of the front and rear, outer surfaces thereof when the drag flask 6 is located adjacent to the molding sand squeeze mechanism 209.

Further, as in FIG. 7, a transfer mechanism 204 for the match plate 105 comprises a ring member 215 pivotably mounted on the bearing shaft 208 of the molding sand squeeze mechanism 209, a cylinder 216 pivotably mounted on the sand blowing mechanism 211 with the distal end of its piston rod being pivotably connected to a part of the ring member 215 so that the distal end moves together with the ring member, a pair of cantilevered arms 217, 217 with their proximal ends being secured to the ring member 123, and a suspended cart 245 carrying the match plate 105 thereon for reciprocatingly moving to the right and left. Accordingly, by extending and retracting the cylinder 216 the pair of the arms 217, 217 are vertically rotated to allow the cart 245 to transfer the match plate 205 to and away from the position between the horizontal cope and drag at the mold squeeze mechanism 209 by way of rails (not shown). By lowering the cart 245 by a short distance by means of the cope flask 3 and by extending and retracting the cylinder 216 to vertically rotate the arms 217, 217, the arms are connected to the card 245 and disengaged from it.

In the molding sand squeeze mechanism 209, as in FIG. 7, the bearing shaft 208 is mounted on the upper central part of the machine base 201, and the rotary frame 218 is pivotably mounted on the bearing shaft 208 so that it is rotated clockwise and counterclockwise in a vertical plane. A pair of vertically extending guide rods 219, 219, which are spaced apart in the frontward and rearward directions, are mounted on the right side of the rotary frame 218. Further, the upper elevating frame 220, which is shaped like an up side down L, is slidably mounted on the guide rods 219,219 at their upper parts through holders integrally formed with the upper elevating frame so that it is held between the upper parts, while the lower elevating frame 221, which is shaped like an L, is slidably mounted on the guide rods 219,219 at their lower parts through holders integrally formed with the lower elevating frame so that it is held between the lower parts. The upper and lower elevating frames 220, 221 are moved toward and away from each other by extending and retracting the upwardly-facing cylinder 222 and the downwardly-facing cylinder 223, which are mounted on the rotary frame 218. Further, the rotary frame 218 has rails (not shown) mounted on it for guiding the cart 245 when the cope and drag flasks 3, 6 are in the horizontal position. The cope flasks 3, 3 have rails (not shown) mounted on them for guiding the cart 245, the rails being disposed at a level that will be the level of the rails mounted on the rotary frame when the cope flasks are raised.

Further, a plurality of cylinders 224, 224 for advancing and retracting the upper squeeze plate 206 are mounted on the upper elevating frame 220, while a plurality of cylinders 225, 225 for advancing and retracting the lower squeeze plate 207 are mounted on the lower elevating frame 221. The horizontal upper surfaces of the upper and lower elevating frame 220, 221 are sized so that they can push the cope flask 3 and drag flask 6.

Further, the sand blowing mechanisms 211 is mounted on the machine base 201 at its top left part and is also provided with two aeration tanks 227, 227 that separately blow-fills the molding sand in the cope flask 3 and the drag flask 6 by pressurized air at a low pressure (aeration filling). Preferably, the low pressure is 0.05-0.18 MPa. Further, the aeration tanks may be connected to a vacuum source and may use air at a pressure lower than the atmosphere in combination. The aeration tanks may be operated simultaneously or by the same controlling, instead of separately or independently controlling them.

In the mold withdrawing mechanism 212, a downwardly-facing cylinder 229 is mounted on the top of the machine base 201, and a withdrawing plate 228 is attached to the lower end of the piston rod of the downwardly-facing cylinders 229. The withdrawing plate 228 is vertically moved by extending and retracting the cylinders 229, so that it can advance in the cope and drag flasks 3, 6 that are stacked and are in the horizontal position. A vertically movable mold receiving table 230 is disposed right under the withdrawing plate 228 for receiving the cope and drag pulled out from the cope and drag flasks 3, 6. The mold-receiving table 230 is vertically moved by a pantograph 232 actuated by a cylinder 231. The mold-receiving table 230 may be vertically moved by a lifter table actuated by a typical cylinder. Using the pantograph eliminates to provide a pit. (See FIG. 8.)

In the mold rotating mechanism 213, a vertically extending rotary shaft 233 is rotatably mounted in the machine base 201. The top of the rotary shaft 233 is connected to the output shaft of a motor 234 mounted on the top of the machine base 201. The rotary shaft 233 is rotated through 180 degrees clockwise and 180 degrees counterclockwise by the motor 234. A cylinder may be used instead of the motor. A supporting member 233 is attached to the upper part of the rotary shaft 233, and two pairs of guide rods 236, 236 are suspended from the supporting member 233. The two pairs of the guide rods 236, 236 are disposed at the right and left about the rotary shaft to oppose to each other. An upper engaging member 237 that engages with the projections 3*a*, 3*a* of the cope flask 3 is tare mounted for vertical sliding on the each pair of the guide rods 236, 236. Each engaging member 237 is connected to the upper end of the piston rod of an upwardly-facing cylinder 238 mounted on the rotary shaft 233. Each engaging member 237 is vertically moved by extending and retracting the cylinder 238. Further, a lower engaging member 239 is attached to the lower ends of the two pairs of the guide rods 236, 236 for engaging with projections 6*a*, 6*a* of the two drag flasks 6, 6. The number 240 in FIGS. 7 and 8 denotes a mold discharging device for removing the cope and drag that have been pulled out from the cope and drag flasks 3, 6 from the mold-receiving table 230.

The process to mold a flaskless cope and drag from the state shown in FIG. 7 using the flaskless molding machine explained above is now explained. First, the cylinder 216 of the transfer mechanism 204 is extended to allow the pair of arms 217, 217 to place the match plate 205 in the position between the cope and drag flasks 3, 6 that are in the horizontal position.

The upwardly-facing cylinder 222 and the downwardly-facing cylinder 223 of the molding sand squeeze mechanism 209 are then retracted to allow the cope flask 3 and the drag flask 6 to approach by means of the upper and lower elevating frame 220, 221 until the flask sandwiches the match plate 205. The plurality of cylinders 224, 224, 225, 225 of the molding sand squeeze mechanism 210 are then extended by a desired distance to advance the upper and lower squeeze plates 206, 207 in the cope and drag flasks 3, 6, thereby determining two molding spaces. At the same time the cylinder 210 is extended to rotate the molding sand squeeze mechanism 209 clockwise about the bearing shaft 208 to place the cope and drag flasks 3, 6 and the match plate 205 in the vertical position and to move up the sand blowing-in ports until they engage with the lower ends of the aeration tanks 227, 227. Instead of using the cylinders 224 and 224, or 225 and 225, a combination of one large cylinder and a guide pin may be used.

Molding sand is then blow-filled into the two molding spaces through the sand blowing-in ports by the sand blowing mechanism 211. While the cope and drag flasks 3, 6 and the match plate 205 are returned to the horizontal position, the squeeze plates 206, 207 are further advanced to squeeze the molding sand the two molding spaces. The upwardly-facing and downwardly-facing cylinders 222, 223 are then extended to separate the upper and lower elevating frames 220, 221.

The cylinders 238 of the mold rotating mechanism 213 are then extended to allow the cope flask 3, which holds the mold produced by squeezing the molding sand, to be suspended from the upper engaging member 237 and be separate from the match plate 205, with the drag flask 6 being placed on the lower engaging member 239 of the mold rotating mechanism 213. The cylinder 216 is then retracted to allow the pair of the arms 217, 217 to take out the match plate 205 from the position between the cope and drag flasks 3, 6. The motor 234 of the mold rotating mechanism 213 is then driven to rotate the rotary shaft 233 by a desired degree to carry the cope and drag flasks 3, 6 holding the mold to the mod withdrawing mechanism 212. A core is set in the mold, if necessary, and the cope flask 3, which holds the mold, is then lowered by retracting the cylinder 238 to place the cope flask 3 on the drag flask 6.

The cylinder 231 of the mold withdrawing mechanism 212 is then extended to raise the mold-receiving table 230 to receive thereon the cope and drag flask 3, 6 holding the mold. The cylinder 229 of the mold withdrawing mechanism 212 is then extended to allow the withdrawing plate 228 to come in contact with the mold in the cope flask 3. The cylinder 231 is then retracted to lower the mold-receiving table 230, while the withdrawing plate 228 is also lowered in unison with the mold-receiving table. Accordingly, the mold is pulled out from the cope and drag flasks 3, 6 onto the mold-receiving table. The mold is then pushed out from the mold-receiving table by the mold discharging device 240.

If it is desired to set a core in the mold in any preceding step before the step of rotating the cope and drag flasks 3, 6 holding the mold to the mold withdrawing mechanism 212, the core is set in that step, and in the manner similar to on explained above the pair of the cope and drag flasks 3, 6 are then stacked, and the mold is withdrawn.

The invention claimed is:

1. A molding machine for molding a cope and a drag that are stacked, comprising:

a flask unit having at least two uprightly disposed connecting rods, a cope flask slidably fitted on the at least two connecting rods and formed with a molding sand blowing-in port in one of the sides thereof, and a drag flask slidably fitted on the at least two connecting rods and being located under the cope flask to mate with the cope flask, the drag flask being formed with a molding sand blowing-in port in one of the sides thereof;

a match plate and a transfer mechanism for placing the match plate in and out of a position between the cope flask and the drag flask of the flask unit when the flask unit is mounted on the molding machine;

a molding sand squeeze mechanism allowing the match plate to be sandwiched between the cope flask and the drag flask, said squeeze mechanism having an upper squeeze means and a lower squeeze means that advance into respective openings of the cope flask and the drag flask of the flask unit that are not closed by the match plate and retract therefrom;

a rotating mechanism for rotating the molding sand squeeze mechanism clockwise and counterclockwise in a vertical plane between a position where the cope flask and the drag flask of the flask unit sandwich a match plate therebetween and are horizontal and a position where the cope flask and the drag flask of the flask unit sandwich the match plate therebetween and are vertical;

a pair of upper and lower clamping mechanisms that engage upper and lower parts of the at least two connecting rods of the flask unit for detachably attaching the flask unit to the molding sand squeeze mechanism and a pair of upper and lower oscillating motors, the upper and lower clamping mechanisms being mounted on an output shaft of each motor so that the clamping mechanisms can be engaged and disengaged with the parts of the at least two connecting rods upon operation of the motors; and a sand blowing mechanism for blowing molding sand into the cope and drag flasks of the flask unit through the sand blowing-in ports thereof when they are in the vertical position, wherein said flask unit can be attached to said molding sand squeeze mechanism and is thereby mounted on the molding machine by engaging the pair of clamping mechanisms with said parts of said at least two connecting rods of said flask unit by operating said oscillating motors, and said flask unit can be detached from said molding sand squeeze mechanism and thereby be taken out from the molding machine by disengaging the pair of clamping mechanisms from said parts of said at least two connecting rods of said flask unit by operating said oscillating motors.

* * * * *